US010614714B2

(12) United States Patent
Abeling et al.

(10) Patent No.: US 10,614,714 B2
(45) Date of Patent: Apr. 7, 2020

(54) METHOD AND DEVICE FOR CLASSIFYING A PARKING SPOT IDENTIFIED WITH THE AID OF A DISTANCE-BASED DETECTION METHOD FOR VALIDITY

(71) Applicant: Robert Bosch GmbH, Stuttgart (DE)

(72) Inventors: Peter Christian Abeling, Hannover (DE); Philipp Mayer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/062,457

(22) PCT Filed: Nov. 22, 2016

(86) PCT No.: PCT/EP2016/078474
§ 371 (c)(1),
(2) Date: Jun. 14, 2018

(87) PCT Pub. No.: WO2017/102268
PCT Pub. Date: Jun. 22, 2017

(65) Prior Publication Data

US 2019/0012918 A1 Jan. 10, 2019

(30) Foreign Application Priority Data

Dec. 16, 2015 (DE) ..... 10 2015 225 415

(51) Int. Cl.
*G08G 1/14* (2006.01)
*G08G 1/01* (2006.01)
*G08G 1/0967* (2006.01)

(52) U.S. Cl.
CPC ..... *G08G 1/147* (2013.01); *G08G 1/0112* (2013.01); *G08G 1/0129* (2013.01);
(Continued)

(58) Field of Classification Search
CPC ..... G08G 1/147; G08G 1/14
(Continued)

(56) References Cited

U.S. PATENT DOCUMENTS 9,747,791 B2 * 8/2017 Mayer ..... G08G 1/0112
2014/0085112 A1 * 3/2014 Gruteser ..... B60Q 9/004 340/932.2

(Continued)

FOREIGN PATENT DOCUMENTS

DE 102004062021 A1 7/2006
DE 102006036423 A1 2/2008

(Continued)

OTHER PUBLICATIONS

International Search Report for PCT/EP2016/078474, dated Jan. 30, 2017.

*Primary Examiner* — Qutbuddin Ghulamali
(74) *Attorney, Agent, or Firm* — Norton Rose Fulbright US LLP; Gerard A. Messina

(57) ABSTRACT

A method for classifying a parking spot identified with the aid of a distance-based detection process for validity, including the following: comparing a position of the identified parking spot to a digital parking facility map which includes positions of valid and invalid parking areas; and classifying the identified parking spot as a valid or an invalid parking spot as a function of the comparison. Also described are a corresponding device, a corresponding parking guidance system, a corresponding motor vehicle, and a computer program.

12 Claims, 3 Drawing Sheets

(52) U.S. Cl.
CPC ..... *G08G 1/0141* (2013.01); *G08G 1/096741* (2013.01); *G08G 1/096791* (2013.01)

(58) Field of Classification Search
USPC ..... 340/932.2
See application file for complete search history.

(56) References Cited

U.S. PATENT DOCUMENTS

| | | | | |
|---|---|---|---|---|
| 2014/0300504 | A1* | 10/2014 | Shaffer | G01S 13/86 342/27 |
| 2015/0248835 | A1 | 9/2015 | Aravkin et al. | |
| 2015/0371540 | A1* | 12/2015 | Gruteser | B60Q 9/004 340/932.2 |

FOREIGN PATENT DOCUMENTS

| | | | |
|---|---|---|---|
| DE | 102009021014 | A1 | 11/2009 |
| DE | 102008028550 | A1 | 12/2009 |
| DE | 102009028024 | A1 | 2/2011 |
| DE | 102014009627 | A1 | 11/2014 |
| DE | 102013211632 | A1 | 12/2014 |
| DE | 102015201810 | A1 | 8/2016 |
| EP | 2261084 | A1 | 12/2010 |
| EP | 2594461 | A1 | 5/2013 |
| WO | 2010132677 | A1 | 11/2010 |

* cited by examiner

METHOD AND DEVICE FOR CLASSIFYING A PARKING SPOT IDENTIFIED WITH THE AID OF A DISTANCE-BASED DETECTION METHOD FOR VALIDITY

FIELD OF THE INVENTION

The present invention relates to a method and to a device for classifying a parking spot identified with the aid of a distance-based detection method for validity. The present invention furthermore relates to a parking guidance system, to a motor vehicle, and to a computer program.

BACKGROUND INFORMATION

The unexamined patent application DE 10 2004 062 021 A1 shows a system for using free parking spots.

The unexamined patent application DE 10 2008 028 550 A2 shows a parking guidance system for navigating a parking space searching vehicle to a free parking space.

The unexamined patent application DE 10 2009 028 024 A2 shows a parking guidance system for navigating a parking space searching vehicle to a free parking space.

SUMMARY OF THE INVENTION

The object underlying the present invention is to provide an efficient concept for efficiently classifying the validity of a parking spot identified with the aid of a distance-based detection method.

This object may be achieved with the aid of the respective subject matter of the independent claims. Advantageous embodiments of the present invention are the subject matter of the respective dependent subclaims.

According to one aspect, a method for classifying the validity of a parking spot identified with the aid of a distance-based detection method is provided, including the following steps:

- comparing a position of the identified parking spot to a digital parking facility map which includes positions of valid and invalid parking areas; and
- classifying the identified parking spot as a valid or an invalid parking spot as a function of the comparison.

According to one further aspect, a device for classifying a parking spot identified with the aid of a distance-based detection method for validity is provided, including:

- a memory in which a digital parking facility map is stored, which includes positions of valid and invalid parking areas; and
- a processor for comparing a position of the identified parking spot to the digital parking facility map and for classifying the identified parking spot as a valid or an invalid parking spot as a function of the comparison.

According to one further aspect, a parking guidance system for navigating a parking space searching motor vehicle to a free parking space is provided, the parking guidance system including the device for classifying the validity of a parking spot identified with the aid of a distance-based detection method.

According to yet another aspect, a motor vehicle is provided, the motor vehicle including the device for classifying the validity of a parking spot identified with the aid of a distance-based detection method.

According to yet another aspect, a computer program is provided, which includes program code for carrying out the method for classifying the validity of a parking spot identified with the aid of a distance-based detection method if the computer program is executed on a computer.

The present invention is based on the finding that not every identified parking spot is valid. This means that parking is not permissible in every identified parking spot. This is because, for example, an identified parking spot may be situated in a no-parking zone. However, since the position of the identified parking spot is compared to a digital parking facility map which includes positions of valid and invalid parking areas, the identified parking spot may be efficiently classified as valid or as invalid. This is achieved as a function of the comparison. It is thus provided that the position of the identified parking spot is compared to the positions of the digital parking facility map.

This in particular thus yields the technical advantage that the validity of a parking spot identified with the aid of a distance-based detection method may be efficiently classified.

This in particular furthermore yields the technical advantage that only parking spots classified as valid may be brought to the attention of parking space searching motor vehicles. In this way, these parking space searching motor vehicles may efficiently drive to the parking spot classified as valid and park there.

If only an identified parking spot were brought to the attention of the parking space searching motor vehicles, without previously classifying this parking spot based on the comparison, it could happen that this identified parking spot is an invalid parking spot, so that the parking space searching motor vehicles would drive in vain to this parking spot, as they could not permissibly park there. In this way, a time expenditure during a search for a parking space may thus advantageously be reduced.

"Valid" within the meaning of the present invention means that it is permissible to park in the parking spot and/or on the parking area.

"Invalid" within the meaning of the present invention means that it is not permissible, i.e., impermissible, to park in the parking spot and/or on the parking area.

An invalid parking area is, for example, a no-parking zone or is situated within a no-parking zone. An invalid parking area is, for example, an entrance or an exit.

According to one specific embodiment, it is provided that a curb parameter is provided, which indicates whether the identified parking spot includes a curb or whether the identified parking spot is free of a curb, the classification being additionally carried out as a function of the provided curb parameter.

This in particular yields the technical advantage that the classification may be efficiently carried out. This in particular yields the technical advantage that, in addition to the position, yet another parameter is available for classifying the identified parking spot. In this way, for example, measuring inaccuracies in the position determination of the identified parking spot may be compensated for. If, for example, the position of the identified parking spot is determined with the aid of a global positioning system (GPS) sensor, it is possible due to GPS inaccuracies that the position of the identified parking spot could not be determined without error.

If an identified parking spot includes a curb, this is generally an indication that this is a valid parking spot, because an absence of a curb, i.e., when the identified parking spot is free of a curb, is generally an indication of an entrance or an exit. In general, however, parking is not permitted in front of an entrance or an exit.

According to one specific embodiment, it is provided that a delimitation parameter is provided, which indicates whether the identified parking spot is delimited on one side and/or on two opposing sides by one motor vehicle and/or two motor vehicles, the classification being additionally carried out as a function of the provided delimitation parameter.

This in particular yields the technical advantage that the classification may be efficiently carried out. This in particular yields the technical advantage, as was already described above in connection with the curb parameter, that inaccuracies in the position determination of the identified parking spot may be compensated for, because, in general, a parking spot which is delimited by a motor vehicle at least from one side is a valid parking spot. This applies, in particular, when the identified parking spot is delimited by two motor vehicles from two opposing sides. In this way, it is generally unlikely that these two motor vehicles are parked in valid parking spots, whereas the parking spot between these two motor vehicles is invalid. These motor vehicles which delimit one side and/or two sides of the parking spot are thus parked motor vehicles.

According to one specific embodiment, it is provided that the identified parking spot is classified as a valid parking spot when the position of the identified parking spot corresponds to a position of a valid parking area and the curb parameter indicates that the identified parking spot includes a curb, and when the delimitation parameter indicates that the identified parking spot is delimited on one side and/or on two opposing sides by one motor vehicle and/or two motor vehicles.

This in particular yields the technical advantage that the classification may be efficiently carried out. This in particular yields the technical advantage that an identified parking spot may be classified with a high probability as a valid parking spot. A high probability denotes in particular a probability of greater than 90% here.

According to one specific embodiment, it is provided that the identified parking spot is classified as an invalid parking spot when the position of the identified parking spot corresponds to a position of an invalid parking area, and when the curb parameter indicates that the identified parking spot is free of a curb, and when the delimitation parameter indicates that the identified parking spot is delimited only on one side by a motor vehicle.

This in particular yields the technical advantage that the classification may be efficiently carried out. This in particular yields the technical advantage that the identified parking spot may be classified with a high probability as invalid. A high probability denotes in particular a probability of approximately 90% here.

According to one specific embodiment, it is provided that, after the classification, a position of the identified parking spot is only transmitted via a communication network if the identified parking spot was classified as valid, so that the position of a parking spot classified as invalid is not transmitted via the communication network after the classification.

This in particular yields the technical advantage that users of the communication network receive only positions of parking spots classified as valid. This efficiently reduces a probability that the users of the communication network who are in general encompassed by a parking space searching motor vehicle drive to the corresponding parking spot and are not allowed to park there. In this way, a time expenditure during a search for a parking space is advantageously reduced in an efficient manner.

According to one specific embodiment, it is provided that the communication network includes a mobile communication network.

According to one specific embodiment, it is provided that, after the classification, the position of the identified parking spot is transmitted via the communication network to a motor vehicle, in particular to a parking space searching motor vehicle.

According to one specific embodiment, it is provided that a motor vehicle carrying out a distance-based detection method, which receives the digital parking facility map via a communication network, is used for identifying a parking spot, the comparison and the classification being carried out locally in the motor vehicle upon identification of a parking spot with the aid of the motor vehicle.

This in particular yields the technical advantage that the result of the classification is directly available in the motor vehicle. In this way, it is possible, for example, to carry out the method according to the present invention even if the communication link should be lost after the digital parking facility map has been received via the communication network.

According to one specific embodiment, it is provided that a motor vehicle carrying out the distance-based detection method is used for identifying a parking spot.

According to one specific embodiment, it is provided that the motor vehicle includes a surroundings sensor system for carrying out the distance-based detection method. A surroundings sensor system includes, in particular, one or multiple surroundings sensor(s). A surroundings sensor is one of the following surroundings sensors, for example: ultrasonic sensor, radar sensor, LIDAR sensor, laser sensor, magnetic sensor, infrared sensor and video sensor, in particular a video sensor of a video camera.

According to one specific embodiment, it is provided that the comparison and the classification are carried out with the aid of a parking guidance system, which receives the position of the identified parking spot via a communication network.

This in particular yields the technical advantage that a result of the classification is centrally available and may thus be efficiently transmitted to users of the communication network.

According to one specific embodiment, it is provided that the device for classifying a parking spot identified with the aid of a distance-based detection method for validity is configured or configured to execute or carry out the method for classifying a parking spot identified with the aid of a distance-based detection method for validity.

According to one specific embodiment, it is provided that the method for classifying a parking spot identified with the aid of a distance-based detection method for validity is carried out with the aid of the device for classifying a parking spot identified with the aid of a distance-based detection method for validity.

Technical functionalities of the device are derived analogously from corresponding technical functionalities of the method, and vice versa. This means in particular that device features are derived from corresponding method features, and vice versa.

According to one specific embodiment, it is provided that the parking guidance system is configured or configured to execute or carry out the method for classifying the validity of a parking spot identified with the aid of a distance-based detection method.

According to one further specific embodiment, it is provided that the motor vehicle is configured or configured to execute or carry out the method for classifying the validity of a parking spot identified with the aid of a distance-based detection method.

The wording "respectively" includes in particular the wording "and/or."

According to one specific embodiment, it is provided that the step of identifying a parking spot with the aid of a distance-based detection method is encompassed by the method for classifying the validity of a parking spot identified with the aid of a distance-based detection method.

The present invention is described in greater detail hereafter based on the exemplary embodiments. Hereafter, identical reference numerals may be used for identical features.

DETAILED DESCRIPTION

Figure 1:
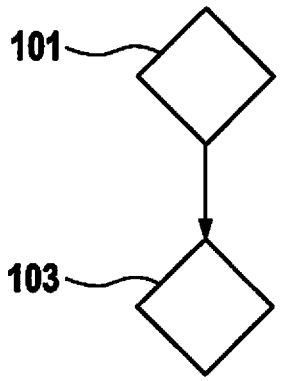
FIG. 1 shows a flow chart of a method for classifying the validity of a parking spot identified with the aid of a distance-based detection method.

FIG. 1 shows a flow chart of a method for classifying the validity of a parking spot identified with the aid of a distance-based detection method.

The method includes the following steps:

comparing 101 a position of the identified parking spot to a digital parking facility map which includes positions of valid and invalid parking areas; and classifying 103 the identified parking spot as a valid or an invalid parking spot as a function of the comparison.

This means that, for example, an identified parking spot is classified as valid when the position of the identified parking spot corresponds to a position of a valid parking area. For example, it is provided that the identified parking spot is classified as an invalid parking spot when the position of the identified parking spot corresponds to an invalid parking area.

According to further specific embodiments, it is provided that a curb parameter, as described above, is used in addition to the comparison of the position of the identified parking spot for classifying the identified parking spot. According to further specific embodiments, it is provided that, additionally, a delimitation parameter, as described above, is used for the classification.

This means that the classification of the identified parking spot as a valid or an invalid parking spot is not based exclusively only on the comparison of the position of the identified parking spot to the digital parking facility map, but additionally also on the curb parameter and/or on the delimitation parameter.

According to one specific embodiment, it is provided that the digital parking facility map includes properties or features or attributes of the valid and/or invalid parking areas. Such features, properties or attributes include, for example, dimensions of the valid and/or invalid parking areas, i.e., for example, lengths and/or depths of the valid and/or invalid parking areas. For example, such features or attributes include curb parameters. This means that it is plotted or indicated in the parking facility map, for example, whether a curb is present or absent in a valid parking area. The same applies to invalid parking areas.

In particular, these properties or features of the valid and/or invalid parking areas are thus, in particular, properties or attributes which may be detected with the aid of the distance-based detection method.

This means, in particular, that a digital parking facility map within the meaning of the present invention indicates in general, for example, whether or not a motor vehicle may permissibly park in a certain location of the parking facility.

The digital parking facility map is thus, in particular, a digital map of a parking facility which includes valid and invalid parking areas.

According to one specific embodiment, the digital parking facility map includes the positions of valid and invalid parking areas and, for example, properties and/or, for example, features and/or, for example, attributes of these valid and invalid parking areas.

Figure 2:
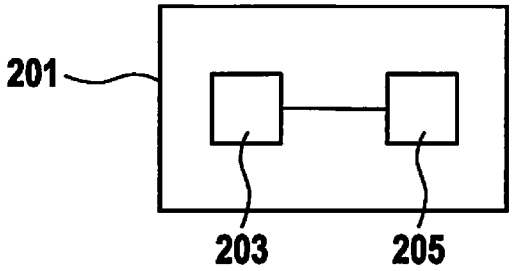
FIG. 2 shows a device for classifying the validity of a parking spot identified with the aid of a distance-based detection method.

FIG. 2 shows a device 201 for classifying a parking spot identified with the aid of a distance-based detection method for validity.

Device 201 includes:

a memory 203 in which a digital parking facility map is stored, which includes positions of valid and invalid parking areas and, for example, properties and/or, for example, features and/or, for example, attributes of these valid and invalid parking areas; and a processor 205 for comparing a position of the identified parking spot to the digital parking facility map and for classifying the identified parking spot as a valid or an invalid parking spot as a function of the comparison.

According to one specific embodiment, device 201 includes a communication interface, which is configured to communicate via a communication network. For example, the communication interface is configured to receive a position of the identified parking spot. For example, the communication interface is configured to transmit a position of the identified parking spot via the communication network.

Figure 3:
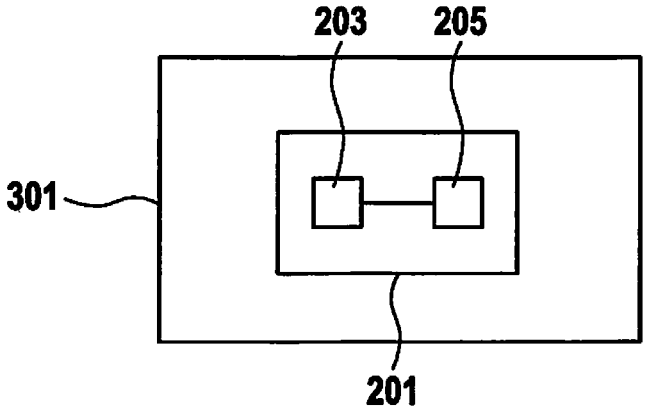
FIG. 3 shows a parking guidance system.

FIG. 3 shows a parking guidance system 301 for navigating a parking space searching motor vehicle to a free parking space.

Parking guidance system 301 includes device 201 of FIG. 2.

Figure 4:
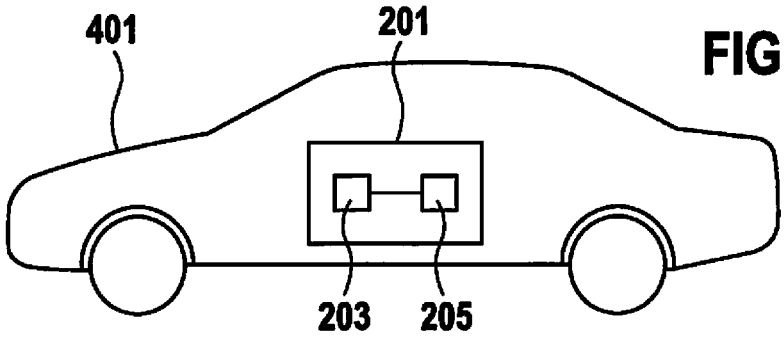
FIG. 4 shows a motor vehicle.

FIG. 4 shows a motor vehicle 401.

Motor vehicle 401 includes device 201 of FIG. 2.

According to one specific embodiment, motor vehicle 401 includes a surroundings sensor system for carrying out a distance-based detection method for identifying a parking spot.

According to one specific embodiment, motor vehicle 401 includes a communication interface for transmitting a position of an identified parking spot to a parking guidance system. According to one specific embodiment, motor vehicle 401 includes a communication interface for receiving a digital parking facility map.

According to one specific embodiment, motor vehicle 401 is configured to identify a parking spot based on a distance-based detection method with the aid of its surroundings sensor system.

According to one specific embodiment, motor vehicle 401 includes a position determination unit for determining a position of the identified parking spot. The position determination unit includes a GPS sensor, for example.

Figure 5:
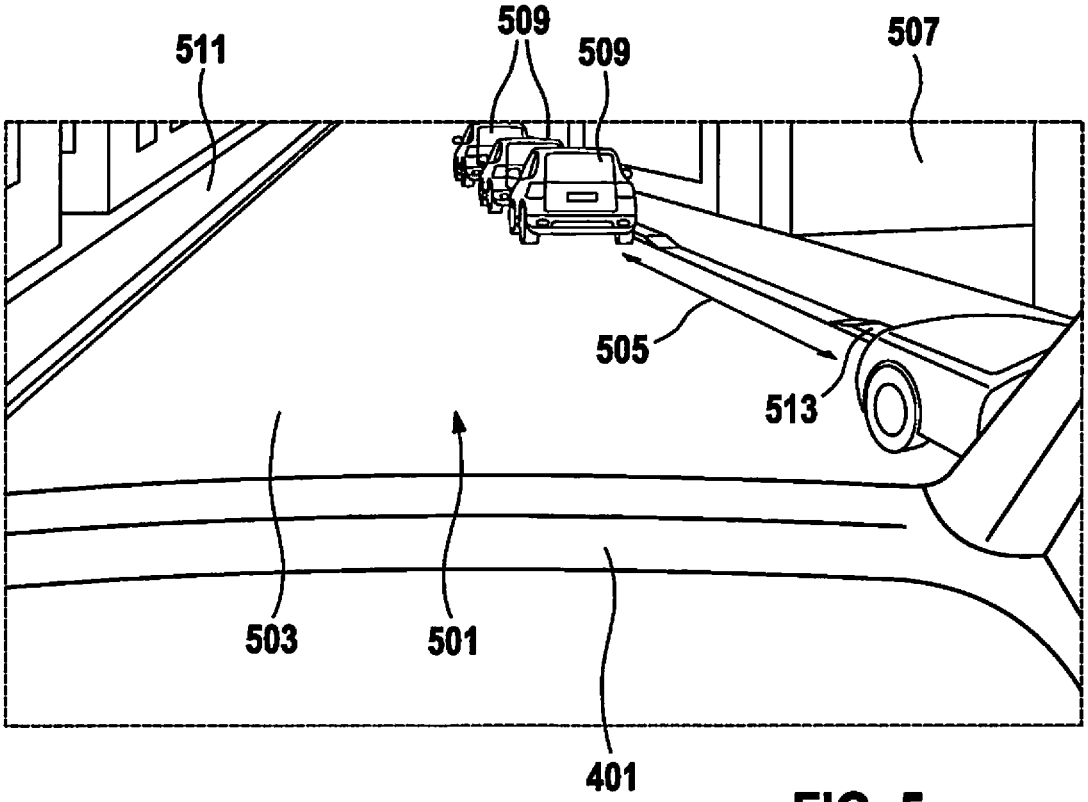
FIG. 5 shows a view through the windshield of the motor vehicle of FIG. 4 during a search for a parking space.

FIG. 5 shows a schematic view 501 through a windshield of motor vehicle 401.

Motor vehicle 401 is driving on a road 503. Based on the paper plane, a sidewalk 511, on which no motor vehicles may park, is situated to the left of the motor vehicle. Sidewalk 511 is thus an invalid parking area. This means that, while motor vehicle 401 is able to park on sidewalk 511, it is not permitted to do so due to statutory regulations.

Multiple motor vehicles 509 are parked to the right of motor vehicle 401, based on the paper plane. A parking spot 505 between motor vehicles 509 is provided, in which motor vehicle 401 could park. This parking spot 505, however, is situated in front of an entrance 507. Thus, a curb 513 is lowered. This means that parking spot 505 is free of a curb 513.

A parking spot including a lowered curb is generally defined as a parking spot which is free of a curb.

In contrast, multiple motor vehicles 509 are parked on valid parking areas.

Figure 6:
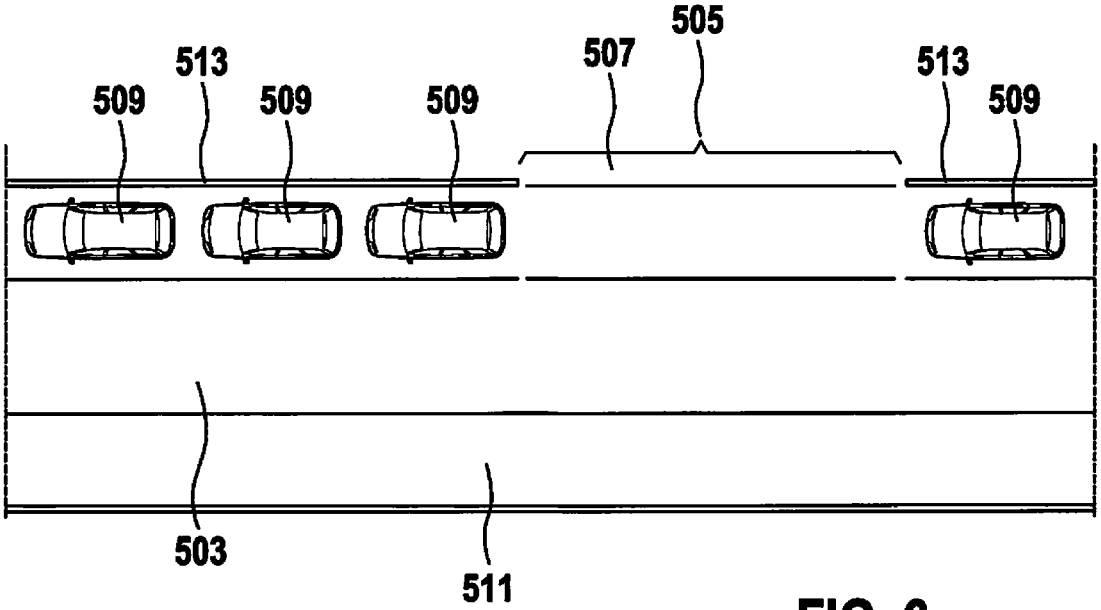
FIG. 6 shows a road on which the motor vehicle of FIG. 5 drives during its search for a parking space in a schematic top view.

FIG. 6 shows a schematic view from above onto road 503, motor vehicle 401 not being shown for the sake of clarity. The parking spot between parked motor vehicles 509 is illustrated with a curly bracket here denoted by reference numeral 505. It is apparent that entrance 507 is free of a curb 513.

Figure 7:
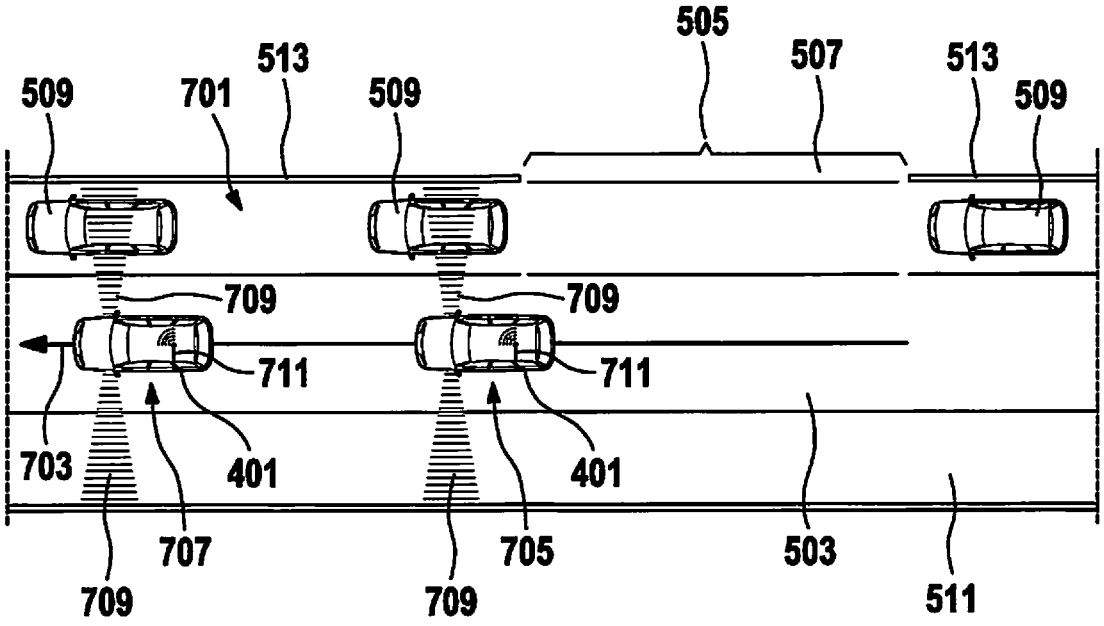
FIG. 7 shows the motor vehicle according to FIG. 4 during its search for a parking space.

FIG. 7 shows the view according to FIG. 6, motor vehicle 401 now being shown during its search for a parking space on road 503, motor vehicle 401 driving in driving direction 703. This is shown at two different points in times 705, 707, point in time 707 being chronologically after point in time 705.

It is apparent that a parking spot 701 opened up between two parked motor vehicles 509, since the motor vehicle parked in between has meanwhile left its position.

This parking spot 701 may be identified with the aid of the surroundings sensor system of motor vehicle 401. This takes place in that motor vehicle 401 drives past parking spot 701 alongside parked motor vehicles 509 and detects its surroundings with the aid of its surroundings sensor system. This detection with the aid of a sensor system is symbolically denoted by reference numeral 709 with the aid of wave-shaped symbols.

Motor vehicle 401 furthermore includes a communication interface 711, which is configured to transmit a position of identified parking spot 701 to a parking guidance system. The parking guidance system is a parking guidance system within the meaning of the present invention.

While motor vehicle 401 is driving in driving direction 703 on road 503, motor vehicle 401, based on its surroundings sensor system, identifies a parking spot 505 in front of entrance 507. However, it is not possible to unambiguously decide solely based on the surroundings sensor system whether parking spot 505 is a valid or an invalid parking spot.

The concept according to the present invention is now based on verifying the identified parking spot with the aid of a digital parking facility map. This means that the position of the identified parking spot is compared to the parking facility map. If the parking spot just identified is now situated in an invalid parking area, the identified parking spot is classified as not valid, i.e., as invalid. In this way, such a parking spot may be filtered out, for example, without displaying it to further users searching for a parking space.

According to one specific embodiment, it is provided that, additionally, a presence of a curb and/or other identified properties of the identified parking spot is compared to the parking facility map. If, for example, no curb is present next to the identified parking spot on the digital parking facility map in the observed location, i.e., at the identified parking spot, this is another indication that the identified parking spot is not a valid parking spot since there is a very high probability that a curb may be found with valid parking spots.

Furthermore, in this way the identified parking spot is advantageously not only verified via its position, but additionally also through the comparison of the curb information. This means that two expected pieces of information must apply to classify an identified parking spot as valid. In this way, for example, different properties of the identified parking spot may be compared to the digital parking facility map to carry out the assessment, i.e., the classification, as to whether this is a valid or an invalid parking spot.

The comparison of the pieces of information, i.e., in particular also the classification, may take place locally in the motor vehicle, for example, and/or in a parking guidance system, which includes a memory in which a digital parking facility map is stored.

If the comparison takes place locally in the motor vehicle, it is provided, for example, that the parking facility map, or a portion thereof, is transmitted from the parking guidance system to the motor vehicle via a communication network. For example, it is provided that the motor vehicle transmits a position of the identified parking spot and/or a curb parameter and/or a delimitation parameter via the communication network to the parking guidance system.

In this way, it may advantageously be decided that parking spot 505 is an invalid parking spot.

Motor vehicle 401 thus drives along road 503 in driving direction 703. It will drive past parking spot 701 and identify it as a parking spot. Here, the comparison to the digital parking facility map will show that identified parking spot 701 is a valid parking spot, since it is situated in a valid parking area and since a curb 513 is present here, and since here, in particular, two motor vehicles 509 are provided which delimit parking spot 701 from two opposing sides.

A check as to whether or not a certain position of the identified parking spot is situated in a valid parking area according to the digital parking facility map is potentially not free of error due to possible inaccuracies in the position determination, such as in the case of inaccuracies in the generation of the digital parking facility map. For this reason, it is provided according to one further specific embodiment that further attributes of the identified parking spot are used to classify it as valid or as invalid. Such an attribute is, for example, a presence or an absence, i.e., a non-presence, of a curb.

A curb delimits, in particular, a parking spot in its lateral direction.

Within the meaning of the present invention, an absent curb is to be equated to a lowered curb.

An attribute, for example, is a delimitation parameter, as described above.

According to one specific embodiment, it is provided that these attributes are used within the scope of the concept according to the present invention in descending significance with respect to the validity. A result of the individual attribute comparisons may be used as an input variable, for example in addition to the determined position, to establish or to classify the validity of a parking spot, for example based on control values.

For example, there is a high probability that parking spots which are circumscribed by two identified motor vehicles and which, at the same time, include a curb as a lateral delimitation, are valid parking spots. When such an arrangement is found and additionally also the determined position of the parking spot is situated within a valid parking area, there is a very high probability that the parking spot is valid. This means that, when such an arrangement is found, the identified parking spot is classified as valid. This means that when such an arrangement is found, it is provided, for example, that the method for classifying ends. If such an arrangement is not found, the method is continued as follows, for example, according to one specific embodiment:

There is a sufficient probability that parking spots which are only delimited by one motor vehicle, i.e., either in front or behind the parking spot based on a driving direction, and which, at the same time, include a curb as a lateral delimitation, are valid parking spots. So when such an arrangement (parking spot including a one-sided delimitation by a motor vehicle and presence of a curb) is identified or found, and when additionally also the determined position of the identified parking spot is situated within a valid parking area, this identified parking spot is classified as valid.

This means that when such an arrangement is found, it is provided, for example, that the method for classifying is terminated. Otherwise, it is provided, for example according to one specific embodiment, that a continuation takes place as follows:

There is an average probability that parking spots which are delimited from two opposing sides, each by one motor vehicle, and which, at the same time, are free of a curb, i.e., do not include a curb as a lateral delimitation, are valid parking spots. When such an arrangement (parking spot including a bilateral delimitation by motor vehicles and free of a curb (or presence of only a lowered curb)) is found or identified, and when also the determined position of the parking spot is situated within a valid parking area, the identified parking spot is classified as valid. In this way, it is provided, for example, that the method for classifying ends here. Otherwise, it is provided, for example according to one specific embodiment, that the method is continued as follows:

There is a low probability that parking spots which are only delimited on one side by a motor vehicle, i.e., another motor vehicle is parked either in front or behind the parking spot, and which, at the same time, are free of a curb as a lateral delimitation, are valid parking spots. When such an arrangement (parking spot including a one-sided delimitation and free of a curb) is identified or found, and when, at the same time, a position of the identified parking spot is also situated within an invalid parking area, such a parking spot is classified as invalid, for example.

In summary, thus in particular the rules are only applied in the case of a lower reliability if it is not possible to apply the more precise rules since a different configuration of the scene exists.

The advantages according to the present invention are, in particular, that an end user only receives valid parking spots, but not spots which, in reality, are situated in no-parking zones or entrances.

The decision, i.e., the classification as to whether or not an identified parking spot is valid, may be made very quickly and efficiently, since the steps described here require only few comparisons, which is favorable and efficient in terms of the computing process technology.

According to one specific embodiment, the verification of parking spots does not take place exclusively via the position of the identified parking spot (for example, the GPS position of the parking spot), which guarantees a higher reliability of the concept according to the present invention.

What is claimed is:

1. A method for classifying a validity of a parking spot identified with the aid of a distance-based detection process, the method comprising:

comparing a position of the identified parking spot to a digital parking facility map which includes positions of valid and invalid parking areas; and classifying the identified parking spot as a valid invalid parking spot or an invalid parking spot as a function of the comparison, wherein there is a curb parameter, which indicates whether the identified parking spot includes a curb or whether the identified parking spot is free of a curb, the classification being additionally carried out as a function of the provided curb parameter.

2. The method of claim 1, wherein there is a delimitation parameter, which indicates whether the identified parking spot is delimited on one side and/or on two opposing sides by one motor vehicle and/or two motor vehicles, the classification being additionally carried out as a function of the provided delimitation parameter.

3. The method of claim 1, wherein the identified parking spot is classified as a valid parking spot when the position of the identified parking spot corresponds to a position of a valid parking area and the curb parameter indicates that the identified parking spot includes a curb, and when the delimitation parameter indicates that the identified parking spot is delimited on one side and/or on two opposing sides by one motor vehicle and/or two motor vehicles.

4. The method of claim 1, wherein the identified parking spot is classified as a valid parking spot when the position of the identified parking spot corresponds to a position of a valid parking area and the curb parameter indicates that the identified parking spot is free of a curb, and when the delimitation parameter indicates that the identified parking spot is delimited on one side and/or on two opposing sides by one motor vehicle and/or two motor vehicles.

5. The method of claim 1, wherein the identified parking spot is classified as an invalid parking spot when the position of the identified parking spot corresponds to a position of an invalid parking area and when the curb parameter indicates that the identified parking spot is free of a curb, and when the delimitation parameter indicates that the identified parking spot is only delimited on one side by a motor vehicle.

6. The method of claim 1, wherein, after the classification, a position of the identified parking spot (505, 701) is transmitted via a communication network only if the identified parking spot (505, 701) was classified as valid, so that the position of a parking spot classified as invalid is not transmitted via the communication network after the classification.

7. The method of claim 1, wherein a motor vehicle carrying out a distance-based detection process, which receives the digital parking facility map via a communication network, is used for identifying a parking spot, the comparison and the classification being carried out locally in the motor vehicle upon identification of a parking spot with the aid of the motor vehicle.

8. The method of claim 1, wherein the comparison and the classification are carried out with the aid of a parking guidance system, which receives the position of the identified parking spot via a communication network.

9. A device for classifying a parking spot identified with the aid of a distance-based detection process for validity, comprising:

a memory to store a digital parking facility map, including positions of valid parking areas and invalid parking areas; and a processor configured to compare a position of the identified parking spot to the digital parking facility map and for classifying the identified parking spot as a valid or an invalid parking spot as a function of the comparison, wherein there is a curb parameter, which indicates whether the identified parking spot includes a curb or whether the identified parking spot is free of a curb, the classification being additionally carried out as a function of the provided curb parameter.

10. A parking guidance system for navigating a parking space searching motor vehicle to a free parking space, comprising:

a device for classifying a parking spot identified with the aid of a distance-based detection process for validity, including:

a memory to store a digital parking facility map, including positions of valid parking areas and invalid parking areas; and a processor configured to compare a position of the identified parking spot to the digital parking facility map and for classifying the identified parking spot as a valid or an invalid parking spot as a function of the comparison, wherein there is a curb parameter, which indicates whether the identified parking spot includes a curb or whether the identified parking spot is free of a curb, the classification being additionally carried out as a function of the provided curb parameter.

11. A motor vehicle, comprising:

a device for classifying a parking spot identified with the aid of a distance-based detection process for validity, including:

a memory to store a digital parking facility map, including positions of valid parking areas and invalid parking areas; and a processor configured to compare a position of the identified parking spot to the digital parking facility map and for classifying the identified parking spot as a valid or an invalid parking spot as a function of the comparison, wherein there is a curb parameter, which indicates whether the identified parking spot includes a curb or whether the identified parking spot is free of a curb, the classification being additionally carried out as a function of the provided curb parameter.

12. A non-transitory computer readable medium having a computer program, which is executable by a processor, comprising:

a program code arrangement having program code for classifying a validity of a parking spot identified with the aid of a distance-based detection process, by performing the following:

comparing a position of the identified parking spot to a digital parking facility map which includes positions of valid and invalid parking areas; and classifying the identified parking spot as a valid invalid parking spot or an invalid parking spot as a function of the comparison, wherein there is a curb parameter, which indicates whether the identified parking spot includes a curb or whether the identified parking spot is free of a curb, the classification being additionally carried out as a function of the provided curb parameter.

* * * * *